US007303150B2

(12) United States Patent
Hildebrand

(10) Patent No.: US 7,303,150 B2
(45) Date of Patent: Dec. 4, 2007

(54) FOAM AND SPRAY NOZZLES HAVING A HINGED DOOR AND A TRIGGER DISPENSER INCORPORATING SAME

(75) Inventor: George R. Hildebrand, Independence, MO (US)

(73) Assignee: MeadWestvaco Corporation, Glen Allen, VA (US)

( * ) Notice: Subject to any disclaimer, the term of this patent is extended or adjusted under 35 U.S.C. 154(b) by 69 days.

(21) Appl. No.: 11/285,633

(22) Filed: Nov. 22, 2005

(65) Prior Publication Data

US 2007/0114303 A1 May 24, 2007

(51) Int. Cl.

| | |
|---|---|
| ***B05B 9/043*** | (2006.01) |
| ***B05B 7/30*** | (2006.01) |
| ***B05B 1/26*** | (2006.01) |
| ***B67D 5/42*** | (2006.01) |
| ***B67D 5/40*** | (2006.01) |
| ***E03C 1/08*** | (2006.01) |

(52) U.S. Cl. ..... 239/333; 239/343; 239/428.5; 239/504; 222/383.1

(58) Field of Classification Search ..... 239/333, 239/343, 428.5, 504, 329, 390, 391, 393, 239/397, 506, 507, 516, 590.3, DIG. 23; 222/383.1, 153.14, 562

See application file for complete search history.

(56) References Cited

U.S. PATENT DOCUMENTS

| | | | | |
|---|---|---|---|---|
| 1,900,087 A | | 3/1933 | Aronson | |
| 4,153,203 A | | 5/1979 | Tada | |
| 4,346,821 A | * | 8/1982 | Wesner et al. | 222/153.02 |
| 4,350,298 A | | 9/1982 | Tada | |
| 4,463,905 A | | 8/1984 | Stoesser et al. | |
| 4,606,480 A | | 8/1986 | Gazulla | |
| 4,730,775 A | | 3/1988 | Maas | |
| 4,768,717 A | | 9/1988 | Shay | |
| 4,779,803 A | | 10/1988 | Corsette | |
| 4,815,663 A | * | 3/1989 | Tada | 239/333 |
| 4,958,754 A | | 9/1990 | Dennis | |
| 5,158,233 A | | 10/1992 | Foster et al. | |
| 5,385,302 A | * | 1/1995 | Foster et al. | 239/333 |
| 5,431,345 A | * | 7/1995 | Lund et al. | 239/329 |
| 5,564,604 A | * | 10/1996 | Tada | 222/153.14 |
| 5,702,058 A | * | 12/1997 | Dobbs et al. | 239/343 |
| 5,706,983 A | * | 1/1998 | Dobbs et al. | 222/153.14 |
| 5,755,384 A | * | 5/1998 | Foster et al. | 239/343 |
| 5,775,594 A | * | 7/1998 | Tasaki et al. | 239/343 |

* cited by examiner

*Primary Examiner*—Darren Gorman
(74) *Attorney, Agent, or Firm*—Gordon & Jacobson, PC

(57) ABSTRACT

A nozzle has a front, a back, and at least one flat surface extending therebetween. A door is coupled to the intersection of the front and flat surface by a live hinge. Optionally, the door has a portal within which a screen is mounted. The exterior surface of the door is provided with one or more curved hooks and the flat surface is provided with corresponding number of mating slots with which the hook(s) engage(s). Preferably, the interior of the door is provided with one or more curved hooks and a corresponding number of mating slots are provided on the front of the nozzle on an edge opposite the live hinge. Preferably, the door is provided with a tab which extends outward beyond the periphery of the nozzle on the edge of the door opposite the live hinge.

18 Claims, 7 Drawing Sheets

FOAM AND SPRAY NOZZLES HAVING A HINGED DOOR AND A TRIGGER DISPENSER INCORPORATING SAME

BACKGROUND OF THE INVENTION

1. Field of the Invention

This invention relates broadly to liquid dispensers. More particularly, this invention relates to liquid dispensers having spray/foam nozzles and a nozzle door.

2. State of the Art

Trigger dispensers are ubiquitous in most American homes. They are supplied on plastic bottles which are used to contain and dispense many different kinds of household liquids such as cleaning liquids, scenting liquids, garden liquids, etc. Traditionally, these sprayers have been provided with a rotatable nozzle which rotates among three positions: off, spray, and stream. More recently, it has been desirable to provide trigger dispensers with a foaming nozzle.

The basic method of creating a foam is to discharge the liquid as a spray toward an obstruction that is vented to the atmosphere. The spray hitting the obstruction mixes the liquid spray with the air of the atmosphere producing the foam that is discharged from the nozzle. One simple way of achieving this is to put a screen in front of a conventional spray nozzle.

Most conventional spray nozzles are either cylindrical, frustroconical, or cubic. On a cubic nozzle, it is known to form a door with a live hinge extending from one of the exposed edges of the nozzle. The door is moveable from an open position where the outlet of the nozzle is not covered to a closed position where the outlet is covered. These doors may be used to protect the nozzle from dirt when the sprayer is not in use, minimize leaking from the nozzle when not in use, or they may be arranged to carry a screen and thereby make a spray nozzle dispense foam. In any case, the doors must be provided with some kind of locking mechanism which will hold them in the selected two positions (opened and closed).

Most nozzle doors lock to the opened or closed position with a frictional engagement. To lock the nozzle door in the opened position, it is known to provide frictionally engaging shoulders on one of the sides of the nozzle. The shoulders are, by necessity of nozzle dimensions, not very deep and thus do not securely engage the door. It is also known to provide an extension on the door with an orthogonal tongue which engages a mating groove or slot in the sprayer housing. This arrangement requires alterations to the sprayer housing as well as the nozzle and is thus more expensive to implement.

SUMMARY OF THE INVENTION

It is therefore an object of the invention to provide spray nozzle with a hinged door.

It is another object of the invention to provide a trigger dispenser with a nozzle having a hinged door.

It is a further object of the invention to provide a nozzle with a hinged door which is lockable in an opened and closed position.

It is also an object of the invention to provide a trigger sprayer with a nozzle having a hinged lockable door which locks securely in the open position.

It is an additional object of the invention to provide a trigger sprayer with a nozzle having a hinged lockable door which locks securely in the open position by locking to part of the nozzle and not to the head of the sprayer.

In accord with these objects, which will be discussed in detail below, the nozzle according to the invention has a front, a back, and at least one side surface extending therebetween. A door is coupled to the intersection of the front and the side surface by a live hinge. Optionally, the door has a portal within which a screen is mounted. According to the invention, the exterior of the door is provided with one or more curved hooks and the side surface is provided with corresponding number of mating slots with which the hook(s) engage(s). According to the presently preferred embodiment, the interior of the door is also provided with one or more curved hooks and a corresponding number of mating slots are provided on the front of the nozzle on an edge opposite the live hinge. Preferably, the door is provided with a tab which extends outward beyond the periphery of the nozzle on the edge of the door opposite the live hinge. According to the illustrated embodiment two hooks are provided on the exterior of the door and a pair of raised ribs are provided adjacent the two slots on the side surface. The nozzle of the invention is illustrated in conjunction with a conventional trigger sprayer which has a housing, a trigger, and a bottle coupling.

Additional objects and advantages of the invention will become apparent to those skilled in the art upon reference to the detailed description taken in conjunction with the provided figures.

DETAILED DESCRIPTION OF THE PREFERRED EMBODIMENTS

Figure 1:
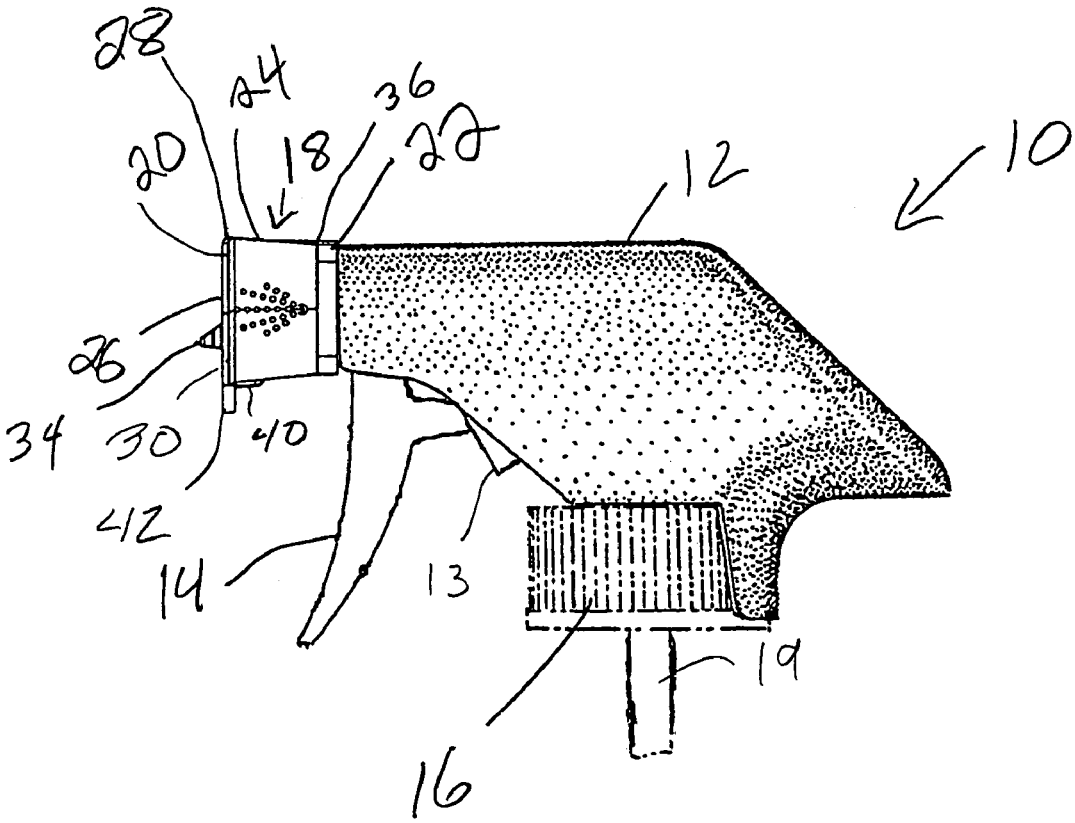
FIG. 1 is a side elevation view of a trigger sprayer incorporating a nozzle according to the invention shown with the door closed.
Figure 2:
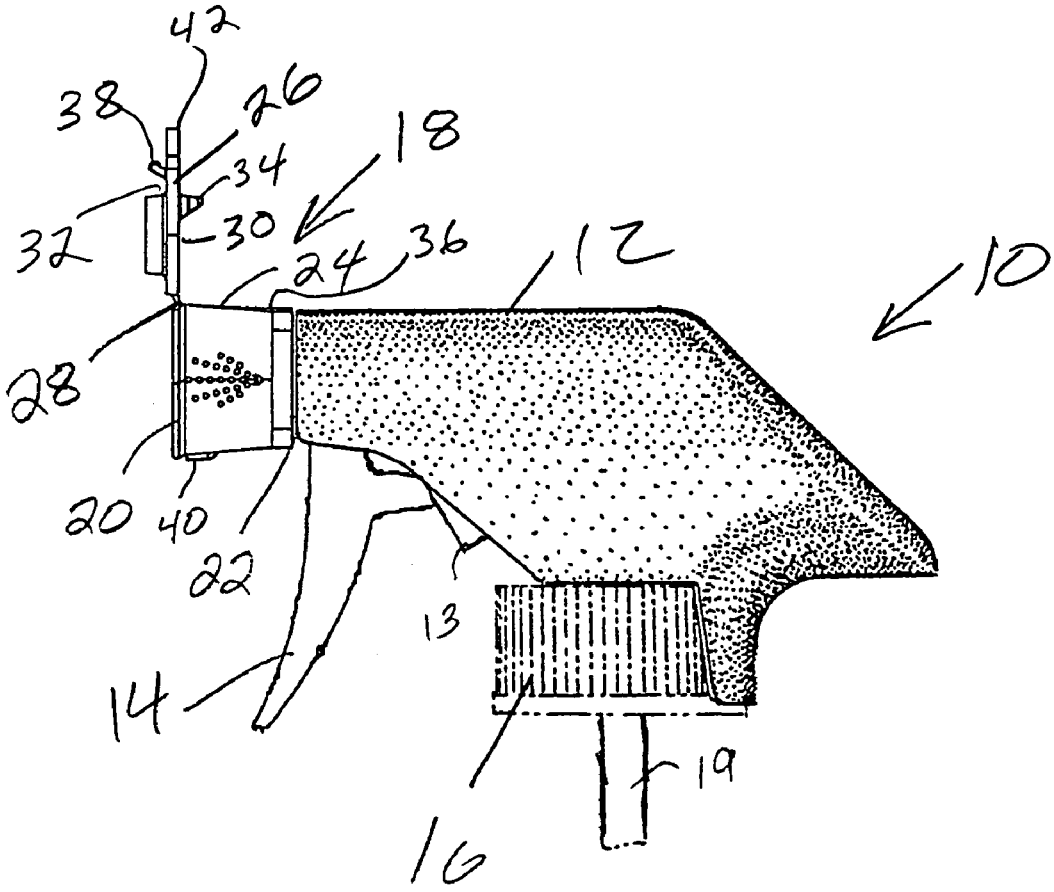
FIG. 2 is a side elevation view of a trigger sprayer incorporating a nozzle according to the invention shown with the door opened but not locked open.
Figure 3:
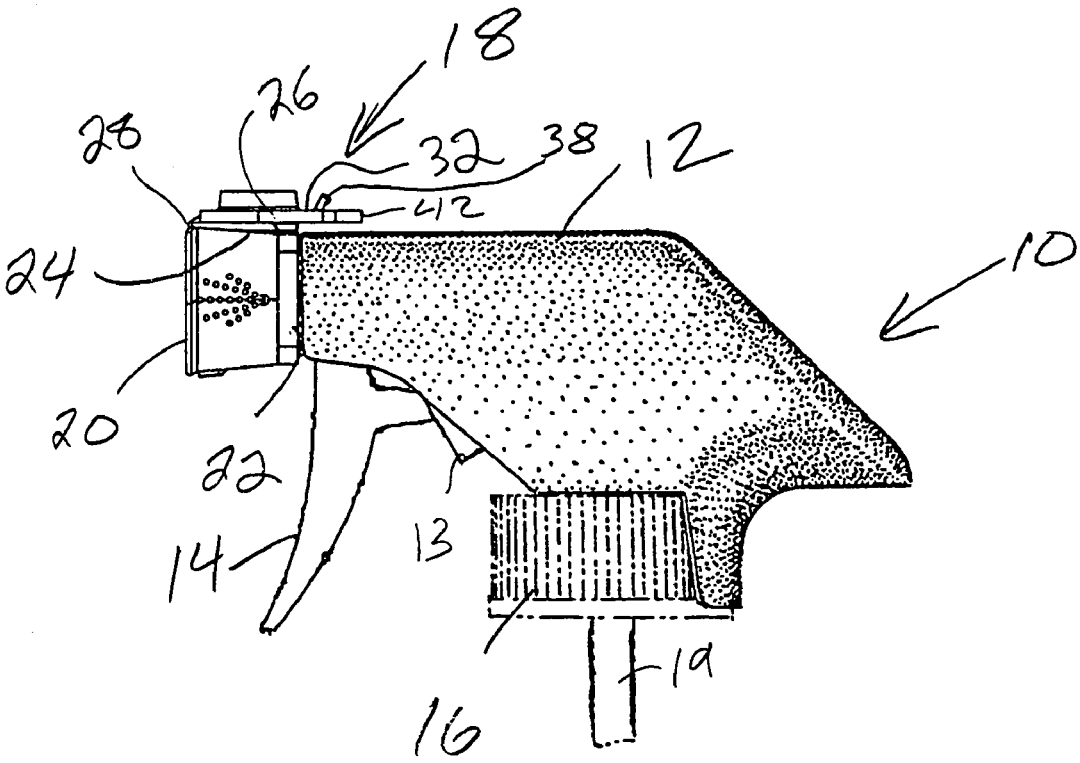
FIG. 3 is a side elevation view of a trigger sprayer incorporating a nozzle according to the invention shown with the door locked open.

Turning now to FIGS. 1-3, a trigger dispenser 10 according to the invention includes a pump housing 12 covering a trigger operated pump 13, a trigger 14 coupled to the pump, a bottle connector 16, a nozzle 18 and an inlet tube 19. The inlet tube 19 is coupled to the inlet of the pump 13 and the outlet of the pump is coupled to the nozzle 18. When the dispenser is coupled to a bottle (not shown) of liquid with the inlet tube 19 extending into the liquid and the trigger 14 is squeezed, the pump 13 draws liquid through the inlet tube 19 and dispenses it out through the nozzle 18.

The nozzle generally includes a front 20, a back 22, and at least one (preferably flat) side surface 24 extending therebetween. A door 26 is coupled to the nozzle by a live hinge 28 at the intersection of the front 20 and the side surface 24. The door 26 has an outer surface 30 and an inner surface 32 with at least one hook 34 extending from the outer surface of the door. The side surface 24 has a corresponding slot 36 which is engaged by the hook 34 when the door is fully opened as shown in FIG. 3. As illustrated, the door 26 has at least one second hook 38 extending from its inner surface 32 which engages a slot 40 in the front of the nozzle when the door is fully closed as shown in FIG. 1. The door also preferably has a tab 42 which extends beyond the periphery of the nozzle on the edge of the door opposite the live hinge 28. The tab facilitates opening and closing the door.

Figure 4:
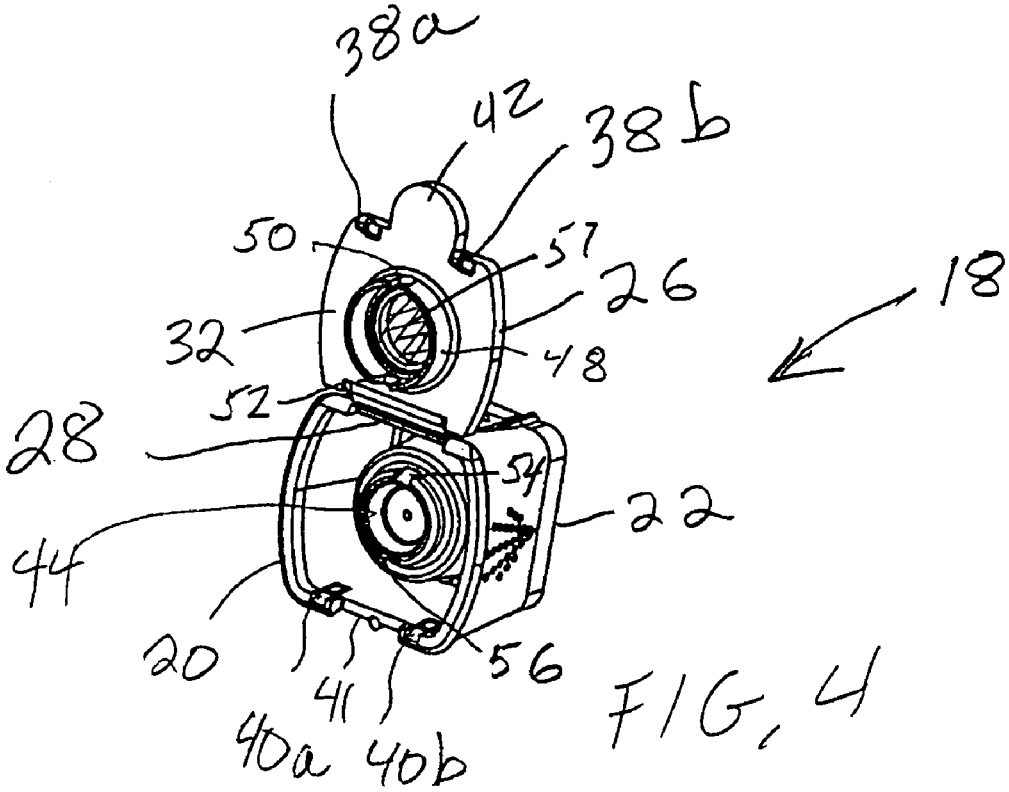
FIG. 4 is a front perspective view of the nozzle according to the invention with the door opened but not locked open.
Figure 5:
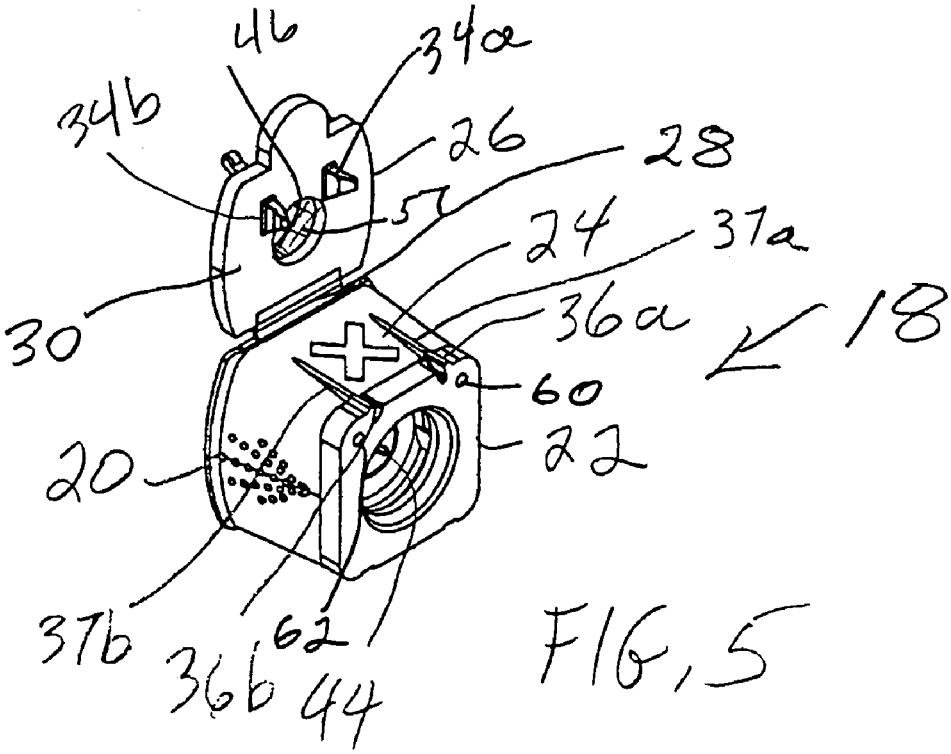
FIG. 5 is a rear perspective view of the nozzle according to the invention with the door opened but not locked open.

Referring now to FIGS. 4 and 5, it can be seen in these perspective views that the nozzle 18 is generally cubic in shape having four sides in addition to the front 20 and the back 22. One of the four sides provides the previously described side surface 24. Inside the cubic structure there is a substantially cylindrical spray head 44. The nozzle 18 with the spray head 44 couple to a conventional trigger dispenser (FIGS. 1-3) pump outlet in a conventional way. Those skilled in the art will appreciate that the nozzle 18 is preferably rotatable about the axis of the spray head 44 and that rotation serves to open and close the fluid path through the spray head. As illustrated, indicia are provided on the sides of the nozzle to indicate whether the fluid path is opened or closed. While the illustrated nozzle shows indicia indicating "spray" and "off", additional indicia and functionality could be added for "stream".

Figure 8:
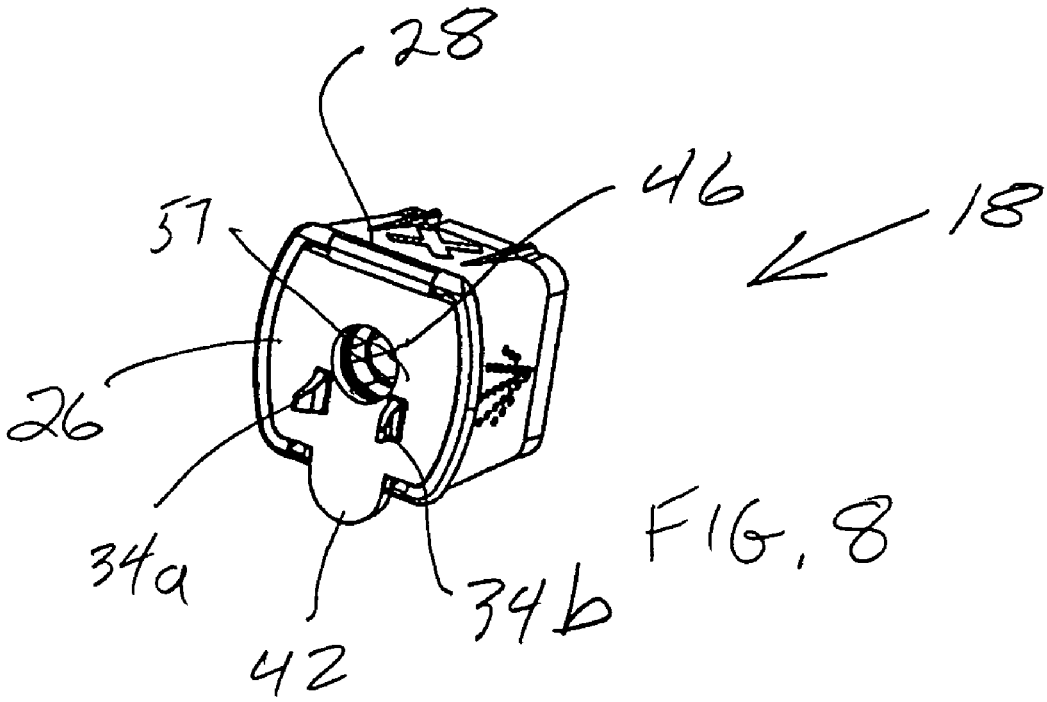
FIG. 8 is a front perspective view of the nozzle according to the invention with the door closed.

As clearly seen in FIGS. 4 and 5, the previously described hooks 34 and 38 and slots 36 and 40 are preferably provided in spaced apart pairs, i.e. hooks 34*a*, 34*b*, 38*a*, 38*b* and slots 36*a*, 36*b*, 40*a*, 40*b*. As seen best in FIG. 4, the slots 40*a*, 40*b* flank a recess 41 which receives the tab 42 when the cover 26 is completely closed (FIGS. 1 and 8). As seen best in FIG. 5, the rear slots 36*a*, 36*b* are preferably flanked by upstanding ribs 37*a*, 37*b* which help guide the hooks 34*a*, 34*b* into the slots 36*a*, 36*b*.

In the embodiment shown in FIGS. 4 through 9, the cover 26 has a circular portal 46 which, when the cover is closed (FIGS. 1 and 8), is substantially coaxial with the spray head 44. On the interior surface 32 of the cover 26, the portal 46 is surrounded by a short cylinder 48 which has a pair of diametrically opposed notches 50, 52. A circular screen 57 is mounted inside the cylinder 48. When the door is closed, the cylinder 48 surrounds the spray head 44 which is provided with matching notches 54, 56. The notches 50, 52, 54, 56 allow air from the atmosphere to enter the space between the spray head 44 and the screen 57. Thus, when the door is closed and the nozzle is rotated to the spray position, foam will be dispensed. FIG. 5 also shows two air holes 60, 62 which allow air to enter the interior of the nozzle.

Figure 6:
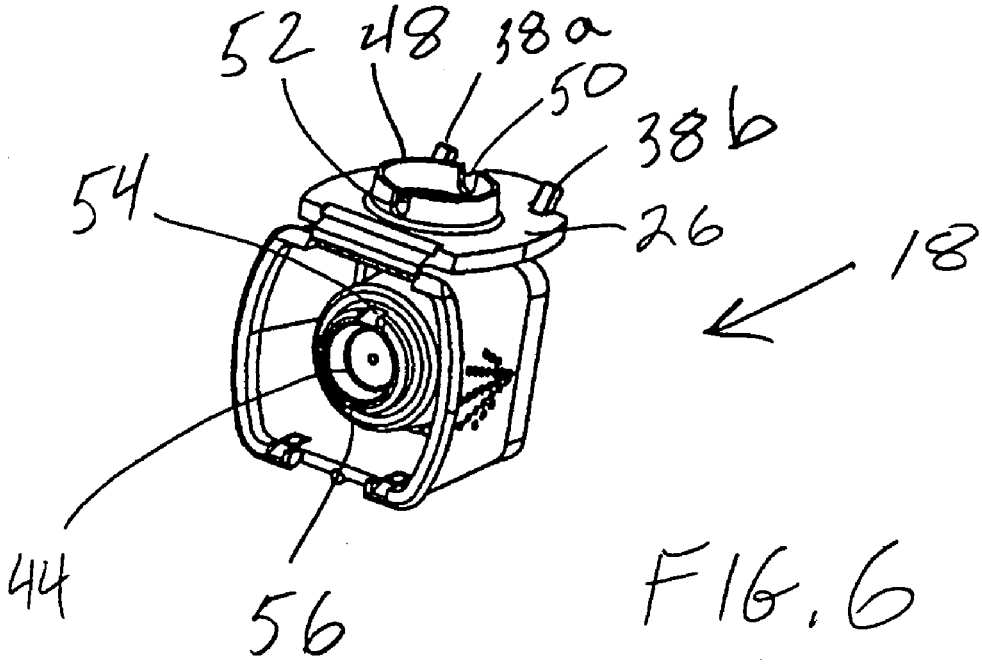
FIG. 6 is a front perspective view of the nozzle according to the invention with the door locked open.
Figure 7:
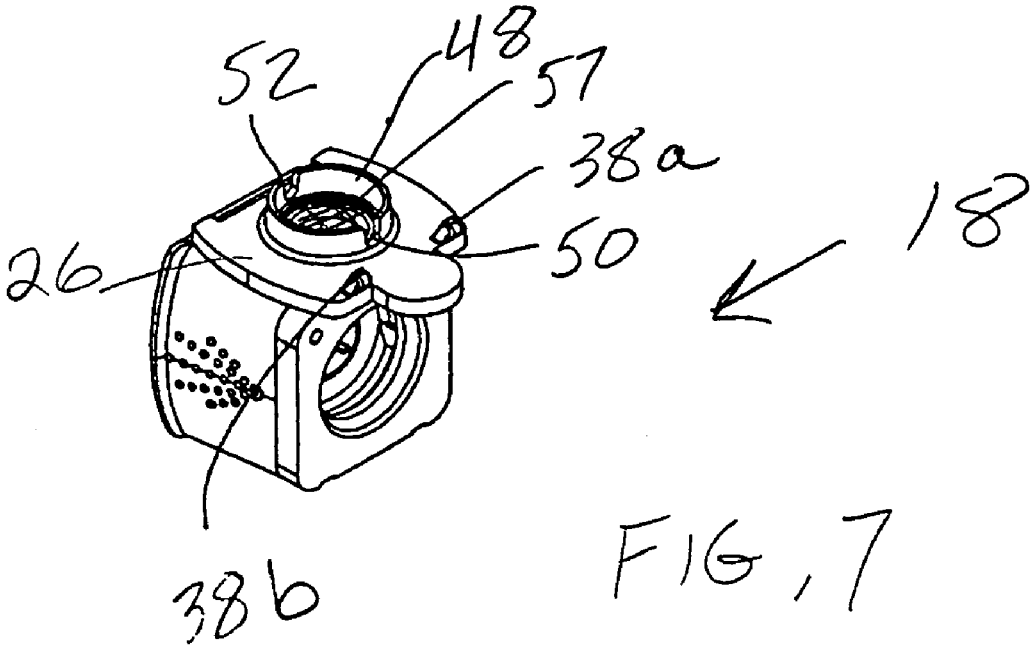
FIG. 7 is a rear perspective view of the nozzle according to the invention with the door locked open.
Figure 9:
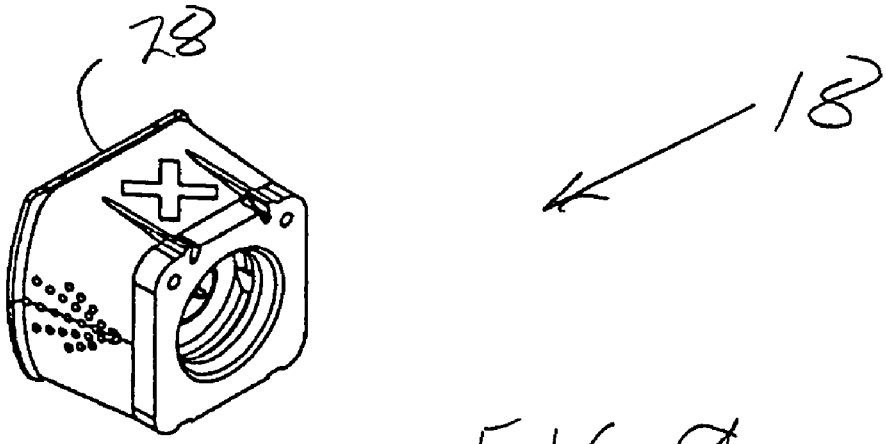
FIG. 9 is a rear perspective view of the nozzle according to the invention with the door closed.

FIGS. 6 and 7 show the door 26 completely opened and FIGS. 8 and 9 show the door completely closed.

Figure 10:
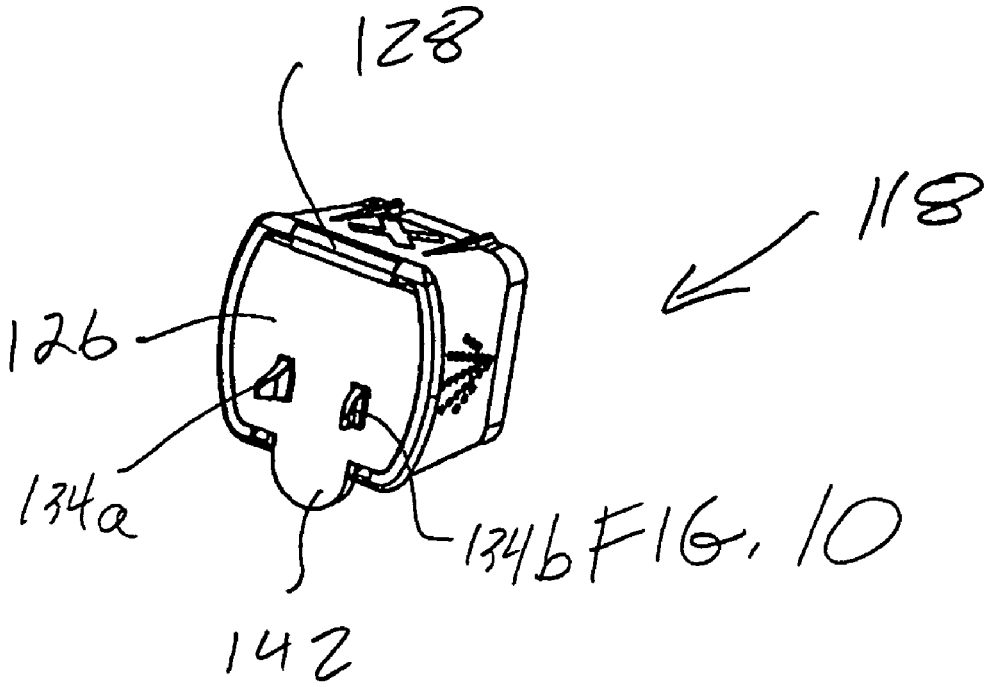
FIG. 10 is a view similar to FIG. 8 but of an alternate embodiment of the nozzle.

FIG. 10 shows an alternate embodiment of a nozzle 118 with similar reference numerals (increased by 100) referring to similar parts. The nozzle 118 differs from the nozzle 18 in that the door 126 does not have a portal and screen. Thus, this nozzle does not produce foam and the door is only used to protect the spray head and/or contain leakage.

There have been described and illustrated herein several embodiments of a foam/spray nozzle and a trigger dispenser incorporating same. While particular embodiments of the invention have been described, it is not intended that the invention be limited thereto, as it is intended that the invention be as broad in scope as the art will allow and that the specification be read likewise. It will therefore be appreciated by those skilled in the art that yet other modifications could be made to the provided invention without deviating from its spirit and scope as claimed.

What is claimed is:

1. A nozzle for a trigger dispenser, comprising:

a front, a back, and at least one side surface extending therebetween with an intersection at the front;

a door coupled to the intersection of the front and side surface by a live hinge, the door having an exterior surface and an interior surface;

a hook extending from the exterior surface of the door;

said side surface having a mating slot with which the hook engages when said door is fully opened; and an upstanding rib adjacent said mating slot and being arranged to guide said hook into said mating slot.

2. A nozzle according to claim 1, wherein:

said door has a portal and a screen is located in said portal.

3. A nozzle according to claim 1, further comprising:

a second hook extending from the interior surface of said door, said front of said nozzle having a second mating slot which the second hook engages when said door is fully closed.

4. A nozzle according to claim 3, further comprising:

a tab which extends outward from said door beyond the periphery of the nozzle on the edge of the door opposite the live hinge.

5. A nozzle according to claim 2, further comprising:

a cylinder extending from said portal.

6. A nozzle according to claim 5, wherein:

said cylinder has at least one notch.

7. A nozzle according to claim 5, further comprising:

a cylindrical spray head, said cylindrical spray head being embraced by said cylinder when said door is closed.

8. A nozzle according to claim 7, wherein:

said cylinder has at least one notch which permits air to enter the space between the cylinder and the spray head.

9. A nozzle for a trigger dispenser, comprising:

a front, a back, and at least one side surface extending therebetween with an intersection at the front;

a door coupled to the intersection of the front and side surface by a live hinge, the door having an exterior surface and an interior surface, said door having a portal with a cylinder extending from said portal on said interior surface, said cylinder having at least one through notch extending through the wall of said cylinder;

a cylindrical spray head, said cylindrical spray head being embraced by said cylinder when said door is closed, said cylindrical spray head having at least one through notch extending through the wall of said cylindrical spray head and aligning with the at least one through notch of said cylinder when said door is closed.

10. A trigger dispenser, comprising:

a pump, a pump housing covering said pump, a trigger coupled to said pump, a bottle coupling coupled to said pump housing, an inlet tube coupled to the inlet of the pump and a nozzle coupled to said pump housing and the outlet of said pump, said nozzle including a front, a back, and at least one side surface extending therebetween with an intersection at the front;

a door coupled to the intersection of the front and side surface by a live hinge, the door having an exterior surface and an interior surface;

a hook extending from the exterior surface of the door; said side surface having a mating slot with which the hook engages when said door is fully opened; and an upstanding rib adjacent said mating slot and being arranged to guide said hook into said mating slot.

11. A dispenser according to claim 10, wherein:

said door has a portal and a screen is located in said portal.

12. A dispenser according to claim 10, further comprising:

a second hook extending from the interior surface of said door, said front of said nozzle having a second mating slot which the second hook engages when said door is fully closed.

13. A dispenser according to claim 12, further comprising:

a tab which extends outward from said door beyond the periphery of the nozzle on the edge of the door opposite the live hinge.

14. A dispenser according to claim 11, further comprising:

a cylinder extending from said portal.

15. A dispenser according to claim 14, wherein:

said cylinder has at least one notch.

16. A dispenser according to claim 14, further comprising:

a cylindrical spray head, said cylindrical spray head being embraced by said cylinder when said door is closed.

17. A dispenser according to claim 16, wherein:

said cylinder has at least one notch which permits air to enter the space between the cylinder and the spray head.

18. A trigger dispenser, comprising:

a pump, a pump housing covering said pump, a trigger coupled to said pump, a bottle coupling coupled to said pump housing, an inlet tube coupled to the inlet of the pump and a nozzle coupled to said pump housing and the outlet of said pump, said nozzle including a front, a back, and at least one side surface extending therebetween with an intersection at the front;

a door coupled to the intersection of the front and side surface by a live hinge, the door having an exterior surface and an interior surface, said door having a portal with a cylinder extending from said portal on said interior surface, said cylinder having at least one through notch extending through the wall of said cylinder;

a cylindrical spray head, said cylindrical spray head being embraced by said cylinder when said door is closed, said cylindrical spray head having at least one through notch extending through the wall of said cylindrical spray head and aligning with the at least one through notch of said cylinder when said door is closed.

* * * * *